United States Patent [19]

Nesseth et al.

[11] 4,439,115

[45] Mar. 27, 1984

[54] MANURE TRANSFER SYSTEM HAVING A PULL PUMP

[75] Inventors: Clinton A. Nesseth; Clifford B. Nesseth, both of Barron, Wis.

[73] Assignee: Butler Manufacturing Company, Kansas City, Mo.

[21] Appl. No.: 63,592

[22] Filed: Aug. 3, 1979

Related U.S. Application Data

[63] Continuation-in-part of Ser. No. 928,591, Jul. 27, 1978, abandoned, which is a continuation of Ser. No. 759,278, Jan. 14, 1977, abandoned.

[51] Int. Cl.[3] ..... F04B 29/00; F04B 19/22; F04B 21/04

[52] U.S. Cl. ..... 417/460; 417/551

[58] Field of Search ..... 417/481–484, 417/460, 469, 551

[56] References Cited

U.S. PATENT DOCUMENTS

| | | | |
|---|---|---|---|
| 546,370 | 9/1895 | Wickenberg | 417/484 |
| 554,164 | 2/1896 | Aiton | 417/551 |
| 1,227,890 | 5/1917 | Crowe | 417/482 |
| 1,558,609 | 10/1925 | Hill . | |
| 1,576,606 | 3/1926 | Haskell | 417/551 |
| 1,599,889 | 9/1926 | Hill et al. | 417/551 |
| 1,727,216 | 9/1929 | Porter | 417/484 |
| 2,231,941 | 2/1941 | Oltman | 417/551 |
| 2,957,430 | 10/1960 | Naef | 103/153 |
| 3,013,702 | 12/1961 | Honisek et al. | 417/460 |
| 3,058,430 | 10/1962 | Handl | 103/167 |
| 3,320,902 | 5/1967 | Paschke | 417/460 |
| 3,667,869 | 6/1972 | Schlecht | 417/346 |
| 3,687,311 | 8/1972 | Nesseth | 417/551 |
| 3,872,981 | 3/1975 | Hedlund | 417/551 |
| 4,180,157 | 12/1979 | Bessette | 417/551 |

OTHER PUBLICATIONS

Engineering Published Nov. 13, 1936, (p. 544).

*Primary Examiner*—William L. Freeh

*Attorney, Agent, or Firm*—Merchant & Gould

[57] ABSTRACT

A manure transfer and storage system (2, 102) includes a manure collection hopper (13) disposed at a first location for receiving manure. A pull pump is operatively mounted in the collection hopper (13) and includes a movable piston body (30, 130) which is cooperable with a cylinder (27) for pumping manure from the collection hopper (13) into cylinder (27). Cylinder (27) is connected to a manure transfer pipe (25, 26) for transferring manure to the second remote storage location. In the first embodiment, piston body (30) telescopically slides over cylinder (27) in a straight line motion. In another embodiment, the piston body (130) is pivotably mounted in collection hopper (13) for arcuate rotation about a pivot axis (134). Piston body (130) includes an arcuate manure confining surface (136) which engages the cylinder (27) only along a single line (144).

16 Claims, 9 Drawing Figures

MANURE TRANSFER SYSTEM HAVING A PULL PUMP

This is a continuation-in-part of U.S. application Ser. No. 928,591, filed July 27, 1978, now abandoned, which is itself a continuation of U.S. appalication Ser. No. 759,278, filed Jan. 14, 1977, now abandoned.

TECHNICAL FIELD

This invention relates generally to a manure transfer and storage system and to a pump for transferring semi-fluid or free-flowing material, such as manure or the like, from one location to another. More particularly, this invention relates to a novel and improved manure pumping apparatus for use in a manure handling and storage system.

DESCRIPTION OF THE PRIOR ART

Transfer apparatuses for transferring manure have been provided heretofore, as for example, the manure transfer apparatus shown in U.S. Pat. Nos. 3,687,311 and 3,876,341. Such prior art manure transfer and storage systems have generally comprised a manure collection hopper which is located at any point where it is desired to collect manure. For example, such collection hoppers have often been installed in barns or other animal enclosures, usually in a sub-surface orientation, for receiving manure through the open top end of the hopper. Generally, a pump cylinder has been attached to the lowest point of the collection hopper extending outwardly therefrom either in a horizontal or a slightly downwardly inclined angle. A mechanical type pump is operable in the bottom of the collection hopper and in the pump cylinder for pumping manure from the collection hopper into the pump cylinder, and from the pump cylinder to a manure transfer pipe. Generally, the pumps which are installed in the prior art systems have a one-way gate valve at the front end thereof. This gate valve opens when the pump piston is retracted to allow a charge of manure to be dispensed down into the pump cylinder and then closes during the power stroke of the pump piston to dispsense the manure charge down through the cylinder.

While the above-noted systems have been effective for pumping manure, various disadvantages are associated therewith. For one thing, the pump cylinder is located at the very bottom of the collection hopper. Thus, if anything goes wrong on the pump cylinder such that repair is needed, as for example the conventional check valve on the cylinder might have to be replaced, reaching the pump cylinder is an onerous task. It usually means that all of the manure residing in the collection hopper and inside the pump cylinder itself has to be shoveled out before the check valve at the front of the cylinder can be reached. Not only is this a time-consuming task, but one which is often an extremely unpleasant procedure.

Another problem with the prior art systems is that the mechanical drive for the pump piston is often located necessarily on one side of the collection hopper. Thus, the conventional type of push type manure transfer pump is not always able to be installed in all operations or installations because of space limitations. For example, in some barns there is insufficient clearance on that side of the collection hopper where the drive must necessarily be located. Accordingly, usage of the more conventional types of prior art manure transfer pumps are somewhat limited because of the construction of the pumps.

Thus, the prior art transfer pumping apparatuses shown in the above prior art patents operate on the principle of creating transfer pressure by a pushing motion. However, in some instances, it is desirable because of space and area conditions to employ a pulling principle.

SUMMARY OF THE INVENTION

Accordingly, in view of the foregoing, one aspect of the present invention is to provide a novel and improved manure transfer and storage system having a pump structure which operates on a pull principle and which is adapted to transfer any semi-fluid or free-flowing material, such as manure.

Another aspect of the present invention is to provide a pull pump apparatus for use in the system which permits the transfer of material by gravity into a collection hopper from which it is loaded into the pump during an extension loading stroke of the piston body. The pull pump of the present invention is simple and compact in structure, economical to manufacture, and efficient in operation.

The present invention comprises a manure transfer and storage system having a novel and improved pump apparatus for transferring material, such as manure or the like, through a manure transfer pipe system to a storage area exterior of an animal housing building, or the like. The system comprises a manure collection pit or hopper disposed beneath the floor of the building for receiving manure from the floor of the building. The pump apparatus comprises a cylinder which may be fixedly disposed in the collection hopper at any angle. The cylinder includes an open inlet end located above the bottom of the collection hopper and an outlet end which is operatively connected to the manure transfer pipe. The inlet end of the cylinder includes a valve which is opened by manure being forced into the cylinder and which is closed by the weight of the manure in the cylinder.

An elongated pump piston having a piston body which is cooperable with the cylinder for pumping manure from the collection hopper into the cylinder is also contained in the collection hopper. The piston body is located generally between the bottom of the collection hopper and the inlet end of the cylinder. The piston body is movably mounted in the collection hopper for movement in an upward direction towards the cylinder and a downward direction away from the cylinder. The piston body has means for loading a charge of manure into the piston body during the downward movement and for dispensing a manure charge into the cylinder during its upward movement such that the manure is, in effect, pulled upwardly from the bottom of the collection hopper into the cylinder. In addition, this system comprises power means connected to the piston body for reciprocating the piston body in its upward and downward directions to pump a plurality of manure charges through the cylinder and into the transfer pipe.

At least two embodiments of the piston body are disclosed herein. In the first embodiment, the piston body is hollow and has a cross-sectional configuration which is similar to but slightly larger than the cross-sectional configuration of the cylinder. In this embodiment, the piston body is slidably and telescopically mounted over the cylinder such that the piston body slides over the cylinder in a straight line motion. In the other embodiment, the piston body is pivotably mounted inside the collection hopper for rotation about a substantially horizontal pivot axis. In this embodiment, the piston body includes an arcuate manure confining surface which engages the cylinder only along a single line to minimize sliding friction therewith.

BRIEF DESCRIPTION OF THE DRAWINGS

The present invention will be described hereafter in conjunction with the following drawings, wherein like reference numerals will refer to like elements throughout.

DETAILED DESCRIPTION

Figures 1, 2:
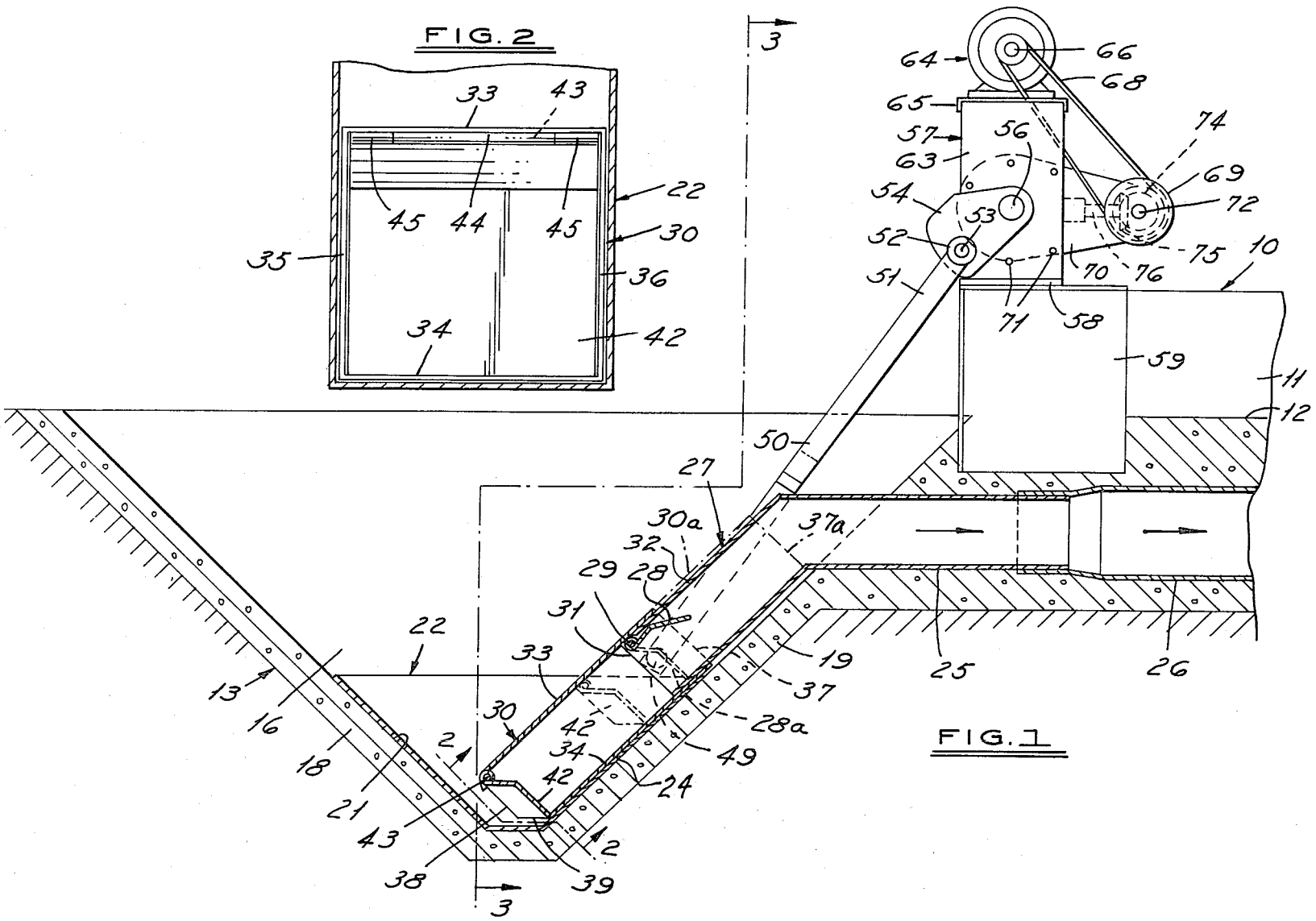
FIG. 1 is a side elevational section view of a manure transfer and storage system made in accordance with the principles of the present invention, particularly illustrating a first embodiment of an improved manure pump operating as a pull-type pump.
FIG. 2 is a fragmentary, enlarged, sectional view of the structure illustrated in FIG. 1, taken along the lines 2—2 thereof, and looking in the direction of the arrows.
Figure 3:
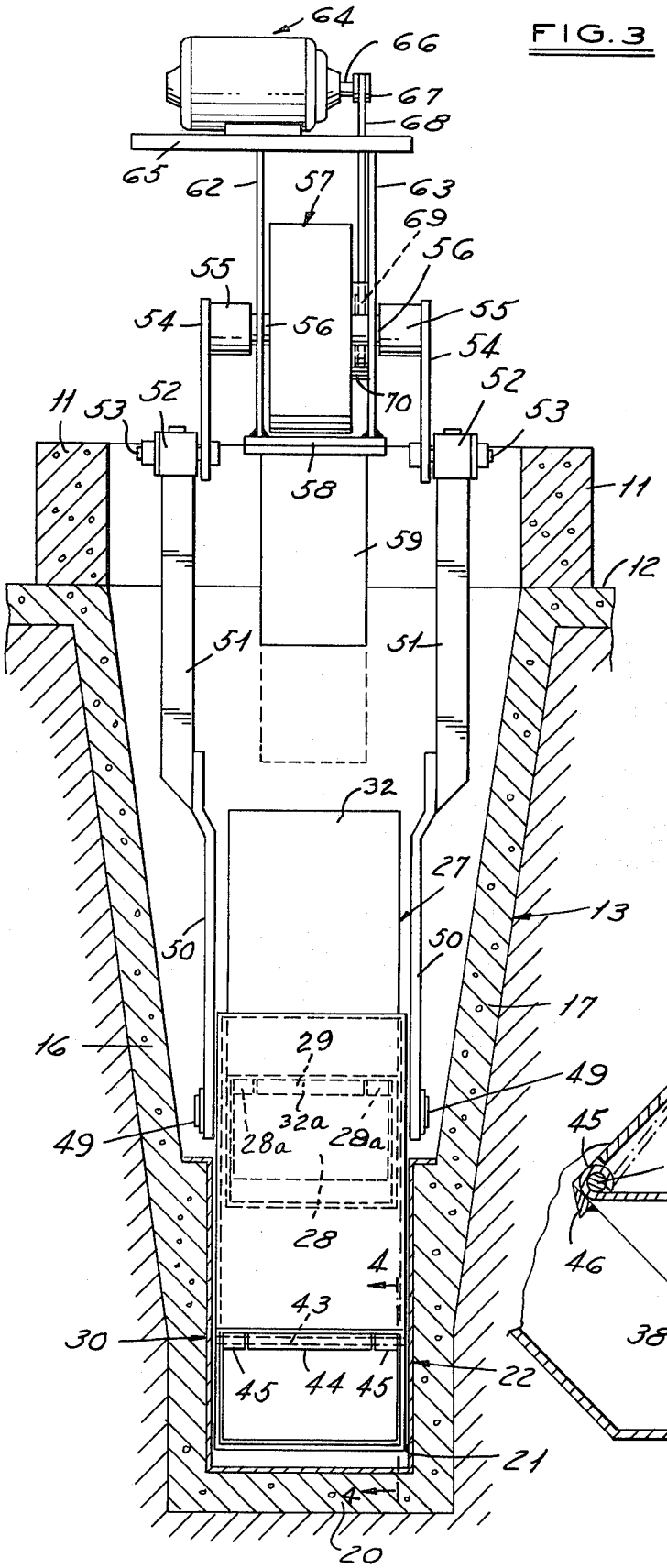
FIG. 3 is an elevational view, partly in section, of the structure illustrated in FIG. 1, taken along the lines 3—3 thereof, and looking in the direction of the arrows.

Referring now to the drawings, and in particular to FIGS. 1 and 3, a manure transfer and storage system according to this invention is generally illustrated as 2. The numeral 10 generally designates a fragmentary portion of a barn or other like building or animal enclosure for housing animals. The numeral 11 indicates a cement wall that is formed on the cement floor 12 in the building 10. System 2 includes a manure hopper or collection pit, generally indicated by the numeral 13, which has cement wall 12 formed around one end thereof. The manure hopper 13 is shown as being formed in the ground below the level of the building floor 12 to ease the task of loading manure into hopper 13. However, hopper 13 need not necessarily be located below the level of floor 12. The manure hopper 13 is open on its upper end, and it may be enclosed by any suitable grid (not shown) as of the type shown for such use in covering the manure collection pit illustrated in U.S. Pat. No. 3,876,341.

The manure collection hopper 13 includes a pair of spaced apart side walls 16 and 17 which are vertically disposed and which converge toward each other. As shown in FIG. 1, the manure collection hopper 13 further includes a front wall 18 and a rear wall 19. The lower end of the manure collection pit is enclosed by the bottom end wall 20 which defines the bottom of collection hopper 13. The manure collection pit 13 is illustrated as being formed from cement, but it will be understood that it may be made from any suitable material. Fixedly mounted by any suitable means in the bottom portion 21 of the manure collection pit 13 is a triangular housing, generally indicated by the numeral 22, which forms a lining for the hopper 13.

System 2 also includes a manure transfer means, operatively mounted in the concrete floor 12, or in the ground beneath floor 12, which includes a first transfer pipe 25 which is connected at its discharge end to an enlarged transfer pipe 26. The transfer pipe 25 is adapted to be connected to a remote manure storage area located at a point exterior of the building 12. The pipes 25 and 26 are shown as being disposed on a horizontal plane although the pipes could be slightly inclined if necessary in reaching the storage location.

System 2 further includes a pull pump for pumping manure from hopper 13 into transfer pipe 25. The inlet end of the transfer pipe 25 is integrally connected to the discharge end of an elongated cylinder, generally indicated by the numeral 27, which forms a portion of the pull pump. The cylinder 27 extends downwardly into the manure collection hopper 13 at an angle, and in a position spaced apart and parallel to the upwardly angled end wall 24 of the housing member 22. The cylinder 27 is preferably rectangular in transverse cross section.

The upper end or outlet end of the cylinder 27 is open at all times to the inlet end of the transverse pipe 25. The lower end or inlet end of the cylinder 27 is indicated by the numeral 31, and it is adapted to be opened and closed by a flapper valve indicated by the numeral 28. The flapper valve 28 is hingedly mounted on one end thereof by a suitable shaft 29 which is operatively carried on the inner or upper side wall 32 of the cylinder 27. The flapper valve 38 closes by gravity, and it is opened by pressure, as described more fully hereinafter. The solid line position of the flapper valve 28 in FIG. 1 shows the valve in the open position, and the broken line position of this valve shows it in the closed position. As shown in FIG. 3, the flapper valve shaft 29 is secured to the cylinder wall 32 by an integral hinge member 32*a*. The flapper valve 28 is provided with a pair of integral hinged members 28*a* which are rotatably mounted on the ends of the shaft 29.

The pull pump further includes a pump piston having a piston body generally indicated by the numeral 30. Piston body 30 is telescopingly and slidably mounted over the cylinder 27, and it is rectangular in cross section to mate with the rectangularly shaped cylinder 27. The piston body 30 includes an upper end wall 33 which is slidably mounted on the outer or top wall 32 of the cylinder 27. The piston body 30 further includes a lower end wall 34 which is slidably mounted over the lower wall of the cylinder 27. As shown in FIG. 2, the piston body 30 further includes a pair of integral side walls 35 and 36 which are slidably mounted over the side walls of the cylinder 27. As shown in FIG. 1, the upper or outlet end of the piston body 30 is open, as indicated by the numeral 37. In FIG. 1, the broken line position of the piston body 30 represents the piston body when it is in its upward position for pulling a load of material into the discharge pipe means 25 and 26. The numeral 37*a* indicates the outlet end 37 of the piston body 30 when the piston body 30 is in its uppermost position.

Figure 4:
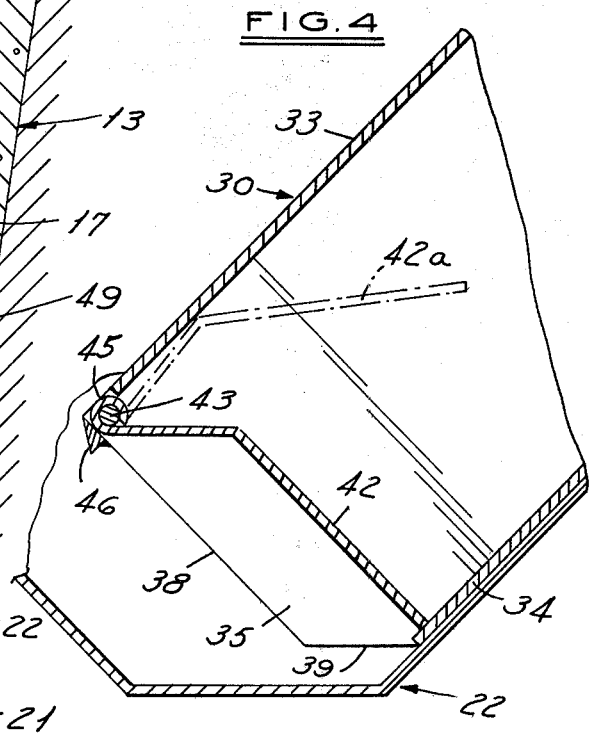
FIG. 4 is a fragmentary, enlarged, elevational view of the structure illustrated in FIG. 3, taken along the lines 4—4 thereof, and looking in the direction of the arrows.

As shown in FIGS. 1 and 4, the lower or inlet end of the piston body 30 is enclosed by a swingably mounted gate valve 42 which is shown in its closed solid line position at a point inwardly and upwardly of the lower open end 38 of the piston body 30. The piston cylinder side walls 35 and 36 are chamfered at their lower rear corners, as indicated by the numeral 39 in FIG. 4. When the piston body 30 is moved downwardly, or to the left, as viewed in FIG. 1, during a piston loading operation, the gate valve 42 is swung by the pressure of the material being forced inwardly into the piston body 30, to the broken line position shown in FIG. 4 and indicated by the numeral 42*a*.

As shown in FIG. 3, the gate valve 42 is swingably mounted at its upper end by a suitable pivot shaft 43 which is secured or held in place by a hinge member 44 that is integrally formed on the lower end of the piston top wall 33. The outer ends of the pivot shaft 43 have pivotally mounted thereon a pair of hinge members 45 which are integrally formed on the outer, upper corners of the gate valve 42. As shown in FIG. 4, a protective shear bar 46 is mounted across the upper edge of the lower end of the piston body 30 to protect the gate valve 42 and restrain its outer pivotal movement to the closed solid line position shown in FIG. 4.

As shown in FIG. 3, the piston body 30 is adapted to be pulled from a lower filled position to an upper discharge position by a pair of elongated connecting rods which each comprise a lower portion 50 and an upper portion 51. Each of the connecting rod lower portions 50 has its lower end rotatably mounted on a journal member 49 which is fixed to the adjacent piston side wall by any suitable means, as by welding. The upper end portions 51 of the connecting rods have fixed journal members 52 which are each rotatably mounted on a shaft 53. The inner end of each of the shafts 53 is operatively carried on the outer end of a crank arm 54. The inner end of each of the crank arms 54 is fixed to a journal member 55 which is operatively connected to an output drive shaft of a gear reducer means, generally indicated by the numeral 57. The gear reducing means 57 is fixedly mounted on a mounting plate 58 which is fixed by any suitable means, as by welding, to a plate that is carried on a support block 59. A pair of vertically extended support plates 62 and 63 have their lower ends fixed, as by welding, to the mounting plate 58, and the gear reducer shafts 56 are operatively extended through said support plates. An electrical drive motor, generally indicated by the numeral 64, is fixedly mounted, by any suitable means on a mounting plate 65 that is positioned, as by welding, on the upper end of the vertical plates 62 and 63. The electrical drive motor 64 is provided with an output shaft 66 on which is fixedly mounted a drive pulley 67. The drive pulley 67 drives a suitable drive belt 68. As shown in FIG. 1, the drive belt 68 drives a driven pulley 69 which is fixed to a drive shaft 72. The drive shaft 72 is operatively supported on a support arm 70 which is attached by suitable machine screws 71 to the vertical support plate 63. The drive shaft 72 has fixedly mounted thereon a beveled gear 74 which is meshed with and which drives a beveled gear 75 that is fixed on the input shaft 76 of the gear reducer 57.

In use, the manure or other material is scraped or pushed into the collection pit or hopper 13 and it then falls by gravity down into the hopper lower end member 22 thereof to be retained in the bottom of hopper 13. When the electric motor 64 is energized, it operates the gear reducer drive means 57 so as to drive the elongated connecting rods which in turn move the piston body 30 upwardly and downwardly between the solid line position and the broken line position shown in FIG. 1. Assuming that the piston body 30 is at the upper end of its stroke, it will be seen that the material in the upper end thereof will have been pulled upwardly into the cylinder 27. The material previously in the cylinder 27 will have been forced to the right, as shown in FIG. 1, into the manure transfer pipe means comprising the pipes 25 and 26. The material in the transfer pipe means at the discharge end thereof would then be discharged into a suitable manure storage means.

The connecting rods then drive the piston body 30 downwardly to the solid line position shown in FIG. 1. During the downward stroke of the piston body 30, the piston body 30 is pushed into the material in the hopper member 22 so as to open the gate 42 and move it to the broken line position 42*a* shown in FIG. 4. When the piston body 30 is again moved upwardly by the connecting rods, the gate 42 closes and the material in the piston body 30 is pulled upwardly and forced into the cylinder 27 past the check valve 28. As the piston body 30 starts the next downward stroke, the material in the cylinder 27 moves back to the lower end thereof to close the check valve 28. The last described cycles are repeated so as to pull the material in the collection hopper 13 upwardly into the cylinder 27, and thence into the manure transfer means comprising the pipes 25 and 26.

FIGS. 5–8 illustrate a second form of the first embodiment of the present invention which is adapted to be mounted vertically. The parts of the embodiment of FIGS. 5–8 which are the same as the first embodiment of FIGS. 1–4 have been marked with the same reference numerals, followed by the small letter "b".

Figure 6:
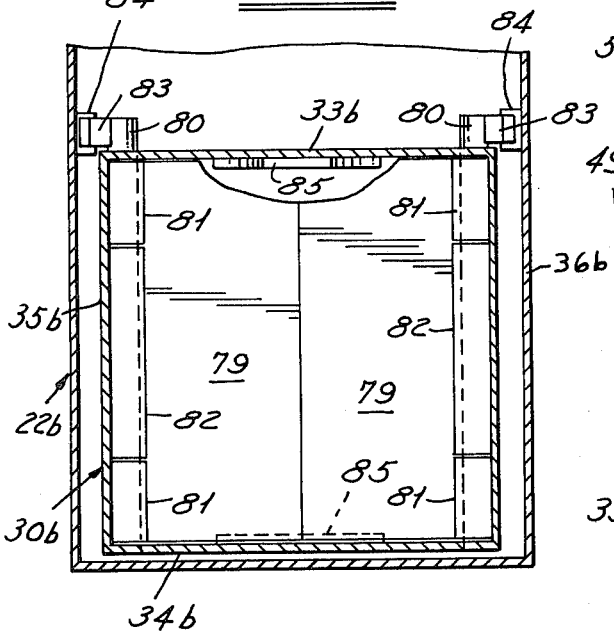
FIG. 6 is a fragmentary, horizontal section view of the structure illustrated in FIG. 5, taken along the lines 6—6 thereof, and looking in the direction of the arrows.
Figure 5:
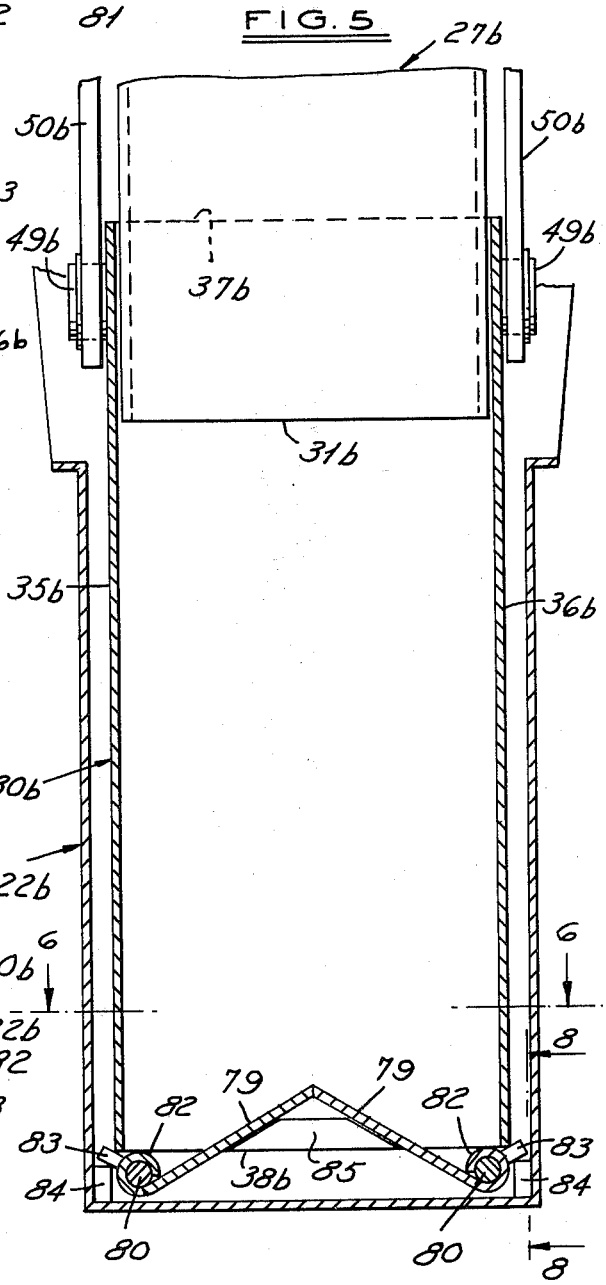
FIG. 5 is a fragmentary, elevational section view of a modified form of a gate valve structure used in the pump of FIG. 1.
Figure 7:
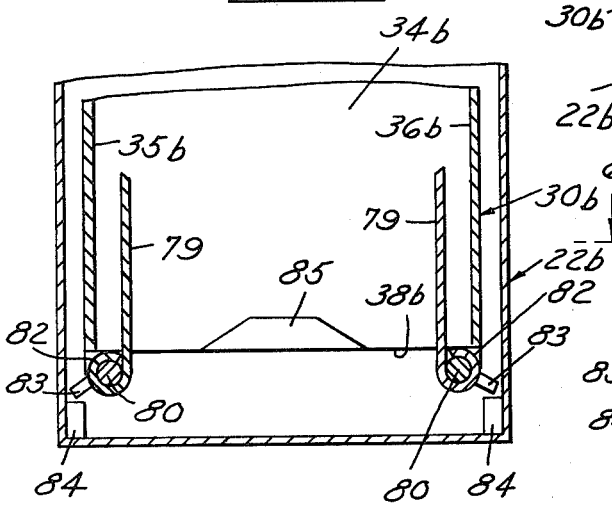
FIG. 7 is a view similar to FIG. 5, and showing the piston gates in an open position.

The second embodiment of FIGS. 5–8 is provided with a modified piston gate valve structure which is mechanically closed when the piston body 30*b* reaches the end of its downward stroke. As shown in FIGS. 5, 6 and 7, the piston gate structure in the second embodiment includes a pair of pivotally mounted gate members 79 each of which has its outer end pivotally mounted on a suitable pivot shaft 80. As shown in FIG. 5, the inner ends of the gates 79 abut each other in the closed position, and in a position wherein they are angled upwardly and inwardly toward each other.

Figure 8:
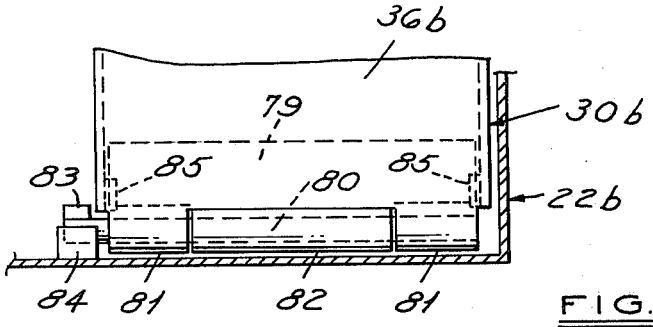
FIG. 8 is a fragmentary, elevational section view of the structure illustrated in FIG. 5, taken along the lines 8—8 thereof, and looking in the direction of the arrows.

As shown in FIGS. 6–8, each of the pivot shafts 80 is secured in a hinge member 82 which is integrally formed on the piston side walls 35*b* and 36*b*. Each of the piston gate members 79 has a pair of integral hinge members 81, formed on the outer ends thereof, in spaced apart positions and they are rotatably mounted on the ends of the adjacent pivot shaft 80. A stop member 85, with angled side edges, is fixedly mounted on the inner surface of each of the upper and lower piston walls 33*b* and 34*b*, and they function as stop members for the gate members 79 when they are in a closed position. As shown in FIGS. 6 and 7, each of the pivot shafts 80 has an operating arm 83 affixed thereto, whereby when the piston body 30*b* is lowered into the collection hopper member 22*b*, the operating arms 83 are each engaged by a bumper block 84 mounted in each of the lower corners of the hopper member 22*b*. It will be seen that as the piston body 30*b* continues its downward movement from the position shown in FIG. 7, the bumper members 84 force the operating arms 83 to move the gate members 79 from the open position shown in FIG. 7 to the positively closed position shown in FIG. 5. In use, the second embodiment of FIGS. 5–8 functions in the same manner for pulling material out of a collection hopper upwardly into the manure transfer means as the first embodiment.

The arrangement of the pull pump which has been described herein for use in manure transfer system 2 has various advantages over the push type of pumps used in prior art systems. For one thing, the cylinder 27 extends upwardly relative to collection hopper 13, rather than being secured to the bottom of the hopper and extending horizontally therefrom. Thus, the piston cylinder flapper valve 28 is located at the top of collection hopper 13, or much nearer the top of 13 than in the prior art systems, to expedite the task of inspecting or replacing valve 28 if it should become jammed. In addition, because the outlet end of cylinder 27 is located substantially above the bottom of hopper 13, the transfer pipe means 25 and 26 may also be located much closer to ground level than previously. This shallow pipe installation is advantageous since manual shut off valves are often placed into the transfer pipes extending downwardly from ground level to the pipes. With the transfer pipes being located closer to the ground, it is easier to install and service these types of valves. In addition, the mere fact that the transfer pipe is closer to the ground increases the safety of installing the system since it lessens the risk of a cave-in when installing the transfer pipes.

Another advantage occassioned by the pull type pump is that the drive connections are simplified as compared to those of prior art systems. For one thing, the connecting rods 51 are generally much shorter in the pull type of system than in the push type since they no longer have to extend as far down into collection hopper 13. In addition, it has been found by the Applicants that the pull force which is required to pull manure into the cylinder 27 is less than the push force needed for the same amount of material. Thus, the connecting rods may be made of a lighter gauge steel, thereby yielding a less expensive system 2. Furthermore, the drive motor and the rest of the power means for propelling the pull pump is now located between the collection hopper and the remote storage location, rather than being located on the other side of the collection hopper as in the prior art system. This allows the system to be installed in barns or other installations where spaced limitations had previously prevented the push type system from being installed. More particularly, whenever the barn presents insufficient clearance between the left side of hopper 13 (as viewed in FIG. 1) and an obstructing wall in the barn, the use of a pull type system 2 is still possible.

Finally, Applicants have found that the pull type pump exhibits what may be termed a very aggressive action. Since the piston bodies 30 are retracted up out of the bottom of collection hopper 13 during the pressure stroke, manure, even the heaviest forms of manure, tend to fall down into the very bottom of collection hopper where they await the extension stroke of piston body 30. Then, during the extension stroke, piston body 30 literally jumps out and grabs anything which is in the bottom of hopper 13. This type of loading action is thought by Applicants to be superior to anything which has yet been produced by a push type of pump.

Figure 9:
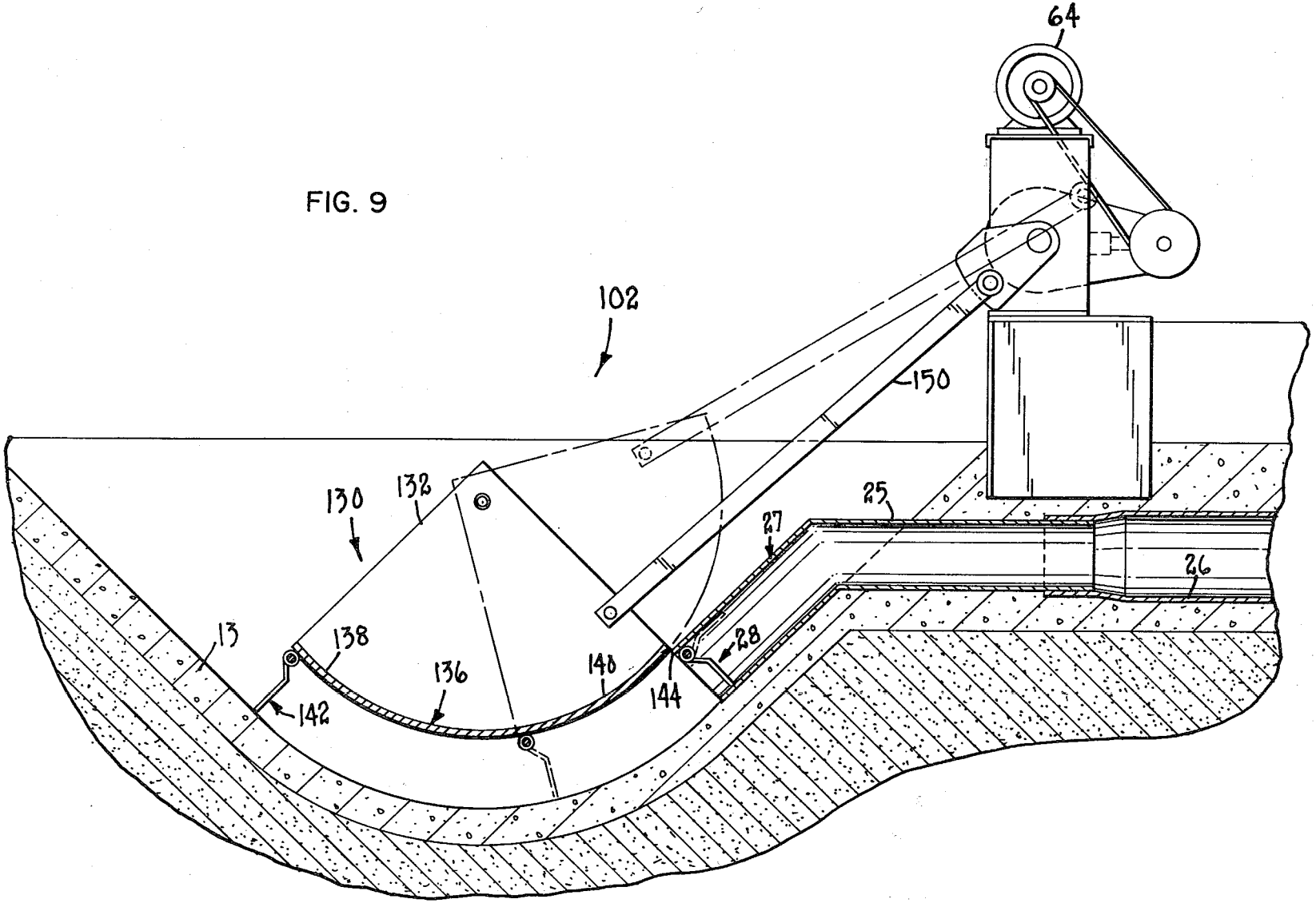
FIG. 9 is a side elevational section view of a manure transfer and storage system made in accordance with the principles of the present invention, particularly illustrating a second embodiment of an improved manure pump operating as a pull-type pump.

Referring now to FIG. 9, another embodiment of a manure transfer and storage system according to this invention has been generally illustrated as 102. Many of the components of system 102 are identical to those described with regard to system 2. For example, the collection hopper 13, the manure transfer means including the manure transfer pipes 25 and 26, the cylinder 27, and the power means (i.e., the connecting rods and motor 64) for reciprocating the piston body are generally identical. Thus, the same reference numerals have been used in illustrating these components as were used in FIGS. 1–8. The primary difference between the embodiment in FIG. 9 and the embodiments of FIGS. 1–8 is in a different type of piston body which is generally shown as 130.

In FIGS. 1–8, piston body 30 disclosed a structure which was reciprocated around cylinder 27 in a straight line, back and forth motion. Piston body 130 as shown in FIG. 9 comprises two transversely spaced side plates 132 having a generally triangular or pie shaped form. Only one side plate 132 is shown in FIG. 9; the other side plate 132 is substantially identically positioned from the plate shown but is simply transversely spaced therefrom. Each of the side plates 132 is rotatably journaled about a substantially horizontal pivot axis 134 inside collection hopper 13. Preferably, each side plate 132 is located substantially adjacent to one of the side walls 16 of hopper 13.

Side plates 132 are integrally joined together along their arcuate bottom edges by a transversely extending manure confining surface 136. Manure confining surface 136 is arcuately arranged about the horizontal pivot axis 134. In fact, manure confining surface 136 lies in a circle whose radius is centered on pivot axis 134. Manure confining surface 136 has an inlet end 138 on which a gate valve 142 is pivotably mounted. Gate valve 142 is substantially identical to gate valve 42 shown in FIG. 1. The other opposed end 140 of manure confining surface 136 is open to define an outlet end for piston body 130 which is adjacent the inlet end of cylinder 27.

The connecting rods 150 are connected in any convenient manner, as by pivot pins or the like, to the side plates 132 adjacent the outlet end 140 of manure confining surface 136. Operation of the drive motor 64 causes the piston body 130 to be reciprocated in upward and downward directions generally between the solid line position and the dotted line position shown in FIG. 9. In the solid line position, the gate valve 142 is located past the bottom of collection hopper 13 and the outlet end 140 of the manure confining surface and is located immediately adjacent the inlet end of cylinder 27. In the dotted line position, the gate valve 142 has been moved through and past the bottom of collection hopper 13 with the outlet end 140 rotating upwardly past the inlet end of cylinder 27. As piston body 130 rotates, however, the only point of engagement between the manure confining surface 136 and cylinder 27 is along a single line identified as 144. The engagement line 144 is substantially coincident with the inlet end of the cylinder.

Piston body 130 in the FIG. 9 embodiment operates similarly to piston body 30. During the downward or extension stroke of the piston body 130, the gate valve 142 will be swung open by the pressure of manure lying in the bottom of the collection hopper 13 to pass inwardly underneath the manure confining surface 136. Manure will be confined between the surface 136 and the bottom and side walls of collection hopper 13. Then, during the upward stroke of the piston body 130, the gate valve 142 will be closed by the pressure of the manure confined beneath the manure confining surface 136. Thus, the gate valve 142 is effective to push the loaded charge of manure upwardly through valve 28 and into the cylinder 27. A plurality of distinct charges are separately loaded by piston body 130 into the cylinder 27 with each new charge pushing the charges already there into the transfer pipes 25 and 26 to the remote storage location.

The primary advantage of the embodiment shown in FIG. 9 is the fact that the manure confining surface 136 engages cylinder 27 only along a single line. Thus, the sliding friction between the piston body 130 and cylinder 27 is greatly reduced as compared to the friction present in a telescopic type of piston body (as in piston body 30). This decrease in sliding friction means that a motor 64 of lesser horsepower could be used to move the same amount of manure. Alternatively, a greater amount of manure could be more speedily loaded given a motor 64 of the same horsepower. Thus, piston body 130 will be more economical to operate.

While piston body 130 includes at least one arcuate manure confining surface 136, this surface could have downwardly depending side walls in the manner of the side walls of piston body 30. However, piston body 130 should not ever have a bottom wall similar to the bottom wall of the piston body 30 because such a wall would not properly clear cylinder 27 during rotation of the piston body 130. Thus, the particular form of piston body 130 as shown herein is not meant to be limiting.

Various modification of this invention will be apparent to those skilled in the art. For one thing, collection hopper 13 has been shown herein as being formed separately from the remainder of the manure transfer and storage system 2. However, hopper 13 could be integrally formed such that the hopper 13 and the pull pump, comprising the cylinder 27, piston body 30 and the power means for reciprocating the piston body, could be formed as a single unit which is manufactured and sold separately and installed as necessary. In addition, any power means which is suitable for reciprocating the piston body could be used. Preferably, the inlet end of cylinder 27 is positioned above the bottom of collection hopper 13 by a difference which is equal to the piston body 30 or 130. However, this spacing could be varied if desired. Thus, this invention is to be limited only by the appended claims.

I claim:

1. A manure transfer and storage system for transferring manure or the like from a first location to a second remote storage location, which comprises:

(a) a manure collection hopper positioned at the first location, wherein the collection hopper includes an open upper end through which manure may be loaded into the collection hopper and a closed bottom for retaining the manure in the collection hopper;

(b) a manure transfer pipe having an inlet spaced from said hopper bottom, for transferring manure from the collection hopper to the remote storage location; and (c) a pull pump for pumping manure from the collection hopper into the manure transfer pipe, wherein the pull pump comprises:

(i) an elongated hollow cylinder fixedly diposed at least partially inside the collection hopper, wherein the cylinder includes an open inlet and located inside the collection hopper above the bottom thereof and an outlet end which is operatively connected to the inlet of the manure transfer pipe, wherein the inlet end of the cylinder includes a valve which is opened by manure being forced into the cylinder and which is closed by the weight of the manure in the cylinder;

(ii) an elongated pump piston having a piston body which cooperatively slidably engages the outer surface of the cylinder for pumping manure from the collection hopper into the cylinder, said body having an exterior surface, wherein the piston body is operatively movable generally between the bottom of the collection hopper and the inlet end of the cylinder, the piston body being movably mounted in the collection hopper for movement in an upward direction towards and in overlying engagement with the cylinder and in a downward direction away from the cylinder, and wherein the piston body has means for loading a charge of manure into the piston body during its downward movement and for dispensing the loaded manure charge into the cylinder during its upward movement such that the manure is lifted upwardly from the bottom of the collection hopper into the cylinder; and (iii) power means connected to said exterior of the piston body for reciprocating the piston body in its upward and downward movement directions to pump a pluarlity of manure charges through the cylinder and into the manure transfer pipe, wherein after passing said valve, the manure charges pass unobstructed by said connected power means through said cylinder to said manure transfer pipe.

2. A manure transfer and storage system as recited in claim 1, wherein the cylinder extends upwardly inside the collection hopper such that the outlet end is disposed above the inlet end thereof, whereby the outlet end of the manure transfer pipe may be laid closer to ground level than would be the case if the cylinder were horizontal.

3. A manure transfer and storage system as recited in claim 1, wherein the length of movement of the piston body in either the upward or downward movement defines the stroke length of the piston body, and wherein the inlet end of the cylinder is located above the bottom of the collection hopper by a distance which is substantially equal to the stroke length of the piston body.

4. A manure transfer and storage system as recited in claim 1, wherein the piston body is hollow and has a cross-sectional configuration which is similar to but slightly larger than the cross-sectional configuration of the cylinder, and wherein the piston body is slidably and telescopically mounted over the cylinder such that the piston body slides over the cylinder in a straight-line motion as it is reciprocated by the power means.

5. A manure transfer and storage system as recited in claim 1, wherein the piston body has inlet and outlet ends, and wherein the means for loading a charge of manure into the piston body includes a gate valve located at the inlet end of the piston body which gate valve opens during downward movement of the piston body and closes during upward movement of the piston body, and wherein the means for dispensing the loaded manure charge into the cylinder includes an open outlet end of the piston body which is cooperable with the inlet end of the cylinder to direct the manure charge into the cylinder.

6. A manure transfer and storage system as defined in claim 5, wherein the gate valve comprises a one-piece gate member having its upper end hingedly supported on one wall of the piston body.

7. A manure transfer and storage system as recited in claim 5, wherein the power means if located on ground level, and wherein the power means includes a connecting rod means connected to the exterior of the piston body substantially adjacent the open outlet end thereof, whereby the connecting rod means is more easily accessible from ground level.

8. A manure transfer and storage system for transferring manure or the like from a first location to a second remote storage location, which comprises:

(a) a manure collection hopper positioned at the first location, wherein the collection hopper includes an open upper end through which manure may be loaded into the collection hopper and a closed bottom for retaining the manure in the collection hopper;

(b) a manure transfer pipe for transferring manure from the collection hoper to the remote storage location; and (c) a pull pump for pumping manure from the collection hopper into the manure transfer pipe, wherein the pull pump comprises:

(i) an elongated hollow cylinder fixedly disposed at least partially inside the collection hopper, wherein the cylinder includes an open inlet end located inside the collection hopper above the bottom thereof and an outlet end which is operatively connected to the manure transfer pipe, wherein the inlet end of the cylinder includes a valve which is opened by manure being forced into the cylinder and which is closed by the weight of the manure in the cylinder, (ii) an elongated pump piston having a piston body which is cooperable with the cylinder for pumping manure from the collection hopper into the cylinder, wherein the piston body is located generally between the bottom of the collection hopper and the inlet end of the cylinder, wherein the piston body is pivotably mounted inside the collection hopper for rotation about a substantially horizontal pivot axis, the piston body being movably mounted in the collection hopper for movement in an upward direction towards the cylinder and a downward direction away from the cylinder, and wherein the piston body includes at least one manure confining surface which retains each manure charge between the surface and the manure collection hopper during its downward movement and for dispensing the loaded manure charge into the cylinder during its upward movement such that the manure is pulled upwardly from the bottom of the collection hopper into the cylinder, and wherein the manure confining surface is arcuate about the pivot axis and is arranged relative to the cylinder such that the manure confining surface engages the cylinder along a single line to minimize sliding friction therewith; and (iii) power means connected to the piston body for reciprocating the piston body in its upward and downward directions to pump a plurality of manure charges through the cylinder and into the manure transfer pipe.

9. A manure transfer and storage system as recited in claim 8, wherein the manure confining surface engages the cylinder adjacent the inlet end thereof.

10. A manure transfer and storage system as recited in claim 8, wherein the piston body further includes two, transversely spaced side plates mounted to each side of the manure confining surface and extending upwardly therefrom, wherein the side plates are rotatably journaled about the pivot axis such that each side plate is adjacent a side wall of the manure collection hopper.

11. A manure transfer and storage system as recited in claim 8, wherein the piston body has inlet and outlet ends, and wherein the means for loading a charge of manure into the piston body includes a gate valve located at the inlet end of the piston body which gate valve opens during downward movement of the piston body and closes during upward movement of the piston body, and wherein the means for dispensing the loaded manure charge into the cylinder includes an open outlet end of the piston body which is cooperable with the inlet end of the cylinder to direct the manure charge into the cylinder.

12. A manure transfer and storage system as defined in claim 11, wherein the gate valve comprises a one-piece gate member having its upper end hingedly supported on one wall of the piston body.

13. A manure transfer and storage system as recited in claim 11, wherein the power means is located on ground level, and wherin the power means includes a connecting rod means connected to the exterior of the piston body substantially adjacent the open outlet end thereof, whereby the connecting rod means is more easily accessible from ground level.

14. A manure transfer and storage system as defined in claim 11, wherein the gate valve comprises a pair of gate valve members having their outer ends hingedly connected to a pair of opposite side walls of the piston body and means for positively closing the pair of gate valve members when the piston body is moved in the upward direction.

15. A manure transfer and storage system as defined in claim 14, wherein the means for positively closing the pair of gate valve members comprises:

(a) an operating arm mounted on each of the gate valve members; and (b) a pair of bumper members mounted on the material collection hopper and engageable by the operating arms for closing the pair of gate valve members when the piston body is moved in the upward direction.

16. A pull pump for use in a manure transfer and storage system for transferring meanure from a first location to a second remote storage location, in which the system includes a manure collection hopper having transversely spaced side walls connected together by a bottom wall, wherein the hopper has an open upper end for loading manure into the hopper and wherein the bottom wall defines a bottom of the hopper for retaining the manure therein, which comprises:

(a) an elongated hollow cylinder fixedly disposed at least partially inside the collection hopper, wherein the cylinder includes an open inlet end located inside the collection hopper above the bottom thereof, and wherein the inlet end of the cylinder includes a valve which is opened by manure being forced into the cylinder and which is closed by the weight of the manure in the cylinder;

(b) an elongated pump piston having a piston body which is cooperable with the cylinder for pumping manure from the bottom of the collection hopper into the cylinder, wherein the piston body is located generally between the bottom of the collection hopper and the inlet end of the cylinder, the piston body being pivotably mounted in the collection hopper for rotation about a substantially horizontal pivot axis for movement in an upward direction towards the cylinder and a downward direction away from the cylinder, the piston body comprising a substantially arcuate manure confining surface having inlet and outlet ends, wherein the inlet end of the manure confining surface has a gate valve which opens during downward movement of the piston body to load a charge of manure between the manure confining surface and the walls of the collection hopper and which closes during upward movement of the piston body to dispense the loaded manure charge through the inlet end of the cylinder, wherein the outlet end of the confining surface is open and engages the exterior of the cylinder along a single line to minimize sliding friction therewith during movement of the piston body; and (c) power means for reciprocating the piston body in the upward and downward directions to pump a plurality of manure charges through the cylinder.

* * * * *